US005378087A

United States Patent [19]

Locotos

[11] Patent Number: 5,378,087

[45] Date of Patent: Jan. 3, 1995

[54] MINE ROOF SUPPORT APPARATUS AND METHOD

[76] Inventor: Frank M. Locotos; 230 Tepee Rd., Bridgeville, Pa. 15017

[21] Appl. No.: 765,374

[22] Filed: Sep. 25, 1991

[51] Int. Cl.[6] ..... E21D 20/00

[52] U.S. Cl. ..... 405/259.5; 405/302.2

[58] Field of Search ..... 405/259.1, 259.5, 259.6, 405/288, 259.2, 259.4, 262, 302.2; 411/2, 3, 5, 8, 9, 14

[56] References Cited

U.S. PATENT DOCUMENTS

| | | | |
|---|---|---|---|
| 3,077,809 | 2/1963 | Harding et al. | 405/302.2 X |
| 3,509,726 | 5/1970 | White | 405/259.1 X |
| 4,265,571 | 5/1981 | Scott | 405/288 X |
| 4,289,427 | 9/1981 | Rolston | 405/259.5 |
| 4,634,318 | 1/1987 | Koumal | 405/288 X |
| 4,648,753 | 3/1987 | Stephan | 411/8 X |
| 4,704,053 | 11/1987 | Hipkins et al. | 405/259.6 |
| 4,750,887 | 6/1988 | Simmons | 405/259.6 X |
| 4,798,501 | 1/1989 | Spies | 405/259.5 |
| 4,904,122 | 2/1990 | Herbst et al. | 405/259.1 |

*Primary Examiner*—David H. Corbin
*Attorney, Agent, or Firm*—Ansel M. Schwartz

[57] ABSTRACT

The present invention pertains to a mining support for supporting rock within a mine. The mining support is constructed of a cable and means for mixing resin in a resin cartridge as the cable is inserted into a bore hole drilled in the rock which the resin cartridge is disposed. In a preferred embodiment, the mixing means is comprised of a helical mixing strand which is fixedly attached to one end of the cable. The mining support can include a drive ferrule, swaged onto the cable, for driving the end of the cable into the bore hole. In a preferred embodiment, the drive ferrule is threaded and there is included a hex nut washer and contact plate for tensioning the cable after the resin has set.

10 Claims, 11 Drawing Sheets

MINE ROOF SUPPORT APPARATUS AND METHOD

FIELD OF THE INVENTION

The present invention is related to mine roof supports. More specifically, the present invention is related to a mine roof support comprising a cable and mixing means, which are secured in a bore hole containing a resin cartridge.

BACKGROUND OF THE INVENTION

It is very well established practice in underground mining work, such as coal mining, tunnel excavation, or the like, to reinforce the roof of the mine to prevent cave-in. There are various types of reinforcement apparatus, the most common are of the mining bolt type. These mining bolts can consist of various designs:

1. Mechanical bolts which have a smooth round shaft—a forged head and a bearing plate on one end, and an expansion anchor at the other. (Tensioned Bolt)

2. Fully grouted resin bolts which consist of a reinforcing bar with a forged head and bearing plate on one end. The rest of the reinforcing bar is left as is. These bolts are used with polyester resin cartridges to grout around the bar and fill the annulus between the bore hole and the reinforcing bar. (Untensioned Bolt)

3. Partially anchored tensioned bolt:

A. A partially anchored (polyester resin) reinforcing bar with a frangible delay nut of various design at the bottom end plus a bearing plate. (Tensioned Bolt) referred to as a "Tension Rebar" Bolt.

B. A partially anchored (polyester resin) reinforcing bar that is threaded at its bottom portion and connected to a smooth bolt on the bottom plus a bearing plate. The reinforcing bar is grouted in polyester resin. The coupling that joins the rebar to the smooth bolt on the bottom has a delay mechanism to permit the resin to be mixed and subsequently allow take up in the coupling after the resin becomes hard. A typical bolt of this design is U.S. Pat. No. 4,477,209 entitled Combo Anchor®. (Tensioned Bolt)

C. A partially grouted smooth bolt that features a nut on the threaded top end to which is attached a mixing wire to mix the resin. The bottom end has a forged head, dual thrust washers, and a bearing plate. This is a tensioned bolt called the "Fastorq Bolt" patented by Dupont.

4. A grouping of bolts using either a headed reinforcing bar or a headed smooth bar with a bearing plate. At the top end is a mechanical anchor that is reinforced with polyester resin. (Tensioned Bolt) A typical bolt of this design is U.S. Pat. No. 4,655,645 entitled Spiral Bolt®.

5. A smooth headed bolt with a buttress deformation at the top end which screws into a compressible plastic formable material and a bearing plate at the bottom. A polyester resin cartridge can also be used to reinforce this anchorage with the plastic tube. (Tension Bolt) U.S. Pat. No. 4,659,295 called "DYNA ROK" Anchors.

6. A long tube of high strength steel, with a slot along its entire length. One end is tapered for insertion into a drilled hole in the roof of the mine. The other end has a welded ring flange to retain a roof plate. This bolt is driven into the hole. (Untensioned Bolt) named Split Set®.

7. A bolt that is manufactured from a steel tube. The tube has been mechanically reshaped to an outer diameter that is smaller. Bushings are pressed onto the ends, which are sealed through welding. The lower bushing is flanged to hold a bearing plate in place. A hole is drilled through the lower bushing and the wall of the tube to allow water to be injected into the bolt. During installation, the high pressure water causes the bolt to expand and forms it to irregularities in the drill hole. After installation, the water pressure is released. (untensioned) Bolt called Swellex®, manufactured by Atlas Copco Co.

8. Screwing a threaded bolt into set resin to attain a tensioned system such as the "Clarich" roof bolt.

9. A bolt which is driven into the roof of a mine, requiring no bore hole, similar to driving a nail into wood. This is called the Pin-Set Bolt®, U.S. Pat. No. 3,643,542; date of issue: Feb. 22, 1972. (Untensioned Bolt).

To further support the roof, it is advantageous to connect steel cable to the mining bolts to support the rock between the bolting sites. In the past, numerous types of cabling systems have been proposed. A company called Ground Control Ltd., located in Canada, markets a cable bolting system that consists of a cable which is positioned into a bore hole. Bonding material is then pumped in under pressure around the cable to secure it to the rock. This cabling system suffers several drawbacks. First, the bonding material must be pumped externally in a separate step after the cable is within the bore hole. Second, the bonding material must also completely fill the bore hole in order to ensure proper contact between the rock and the cable.

Another design for a cabling system is manufactured by Ingersoll-Rand Co., Inc. and is called the Scott Cable Sling System. The apparatus consists of a cable to which is permanently attached to a stiff drive member. The cable and drive member are forced into a bore hole containing a cementatios grout. Unfortunately, after installation is complete, the drive members hang below the bore hole thereby decreasing roof clearance. Further, two drive members must be wasted each time a cable is installed.

A further design for a cable-type mining support is made by Arnall, Inc. Arnall manufactures a stranded cable a length of which has an open-weave arrangement. (i.e. the strands are not tightly wound). This allows a bonding agent of cementatios grout, which is pumped into a bore hole, to penetrate into and integrate with the cable.

The present invention discloses a mining support which is less complicated and easier to install than previous cabling systems known in the prior art.

SUMMARY OF THE INVENTION

The present invention pertains to a mine roof support for supporting rock within a mine. The mine roof support is constructed of a cable and means for mixing resin in a resin cartridge as the cable is inserted into a bore hole drilled in the rock which the resin cartridge is disposed. In a preferred embodiment, the mixing means is comprised of a helical mixing strand which is fixedly attached to at least one end of the cable.

The mine roof support can include a drive ferrule, swaged onto the cable, for driving the end of the cable into the bore hole. In a preferred embodiment, the drive ferrule is threaded and there is included a hex nut washer and contact plate for tensioning the cable after the resin has set. In an alternative embodiment, the mine roof support includes an end ferrule having a threaded portion for tensioning the cable and a spacer disposed on the drive ferrule for filling space in the bore hole and for driving the drive ferrule.

The present invention also pertains to a drive tool for driving a metal cable having drive ferrules disposed in proximity to either end of the cable into a bore hole containing a resin cartridge. The tool is constructed of a metal bar, a portion of which has a u-shaped cross section such that the drive tool can bear against the drive ferrule for driving the cable into the bore hole, yet is removable from the cable after the cable has been positioned in the bore hole.

The present invention pertains to a method of supporting rock in a mine comprising the steps of drilling a first bore hole and a second bore hole into the rock. Then, there is the step of inserting a resin cartridge into each bore hole. Next, there is the step of orienting a first end of a cable having a wire strand within the first bore hole wherein a first drive ferrule is disposed in proximity to the first end of the cable. The first wire strand is disposed in proximity to the first end of the cable. Then, there is the step of forcing the first drive ferrule towards the first bore hole with a removable drive tool to puncture the resin cartridge and to position the first end of the cable within the first bore hole. Next, there is the step of orienting a second end of a cable having a second wire strand within the second bore hole wherein a second drive ferrule is disposed in proximity to the second end of the cable. The second wire strand is disposed in proximity to the second end of the cable. Finally, there is the step of forcing the second drive ferrule towards the second bore hole with a removable drive tool to puncture the resin cartridge and to position the second end of the cable within the second bore hole such that the cable is pulled tight between the bore holes. An alternative method is described wherein both ends of the cable are inserted into their respective bore hole at the same time.

The present invention also pertains to a method of supporting rock in the roof of a mine comprising the steps of drilling a first bore hole and a second bore hole each having a first diameter and first length into the rock. Then, there is the step of drilling a first countersink hole and a second countersink hole, concentric with the first and second bore holes, respectively, each having a second diameter larger than the first diameter and a second length smaller than the first length. Next, there is the step of anchoring a first rock bolt within the first bore hole. The first bolt is attached to the first end of a cable with a first connector element. The first connector element disposed within the first countersink hole after the first angle bolt is anchored. Finally, there is the step of anchoring a second rock bolt within the second bore hole. The second rock bolt is attached to the second end of a metal cable with a second connector element. The second connector element is disposed within the second countersink hole and the cable is taught after the second rock bolt is anchored.

Applicant's invention is also a support comprising a cable and means for anchoring the cable to a first layer. The anchoring means has a holding strength against the cable greater than the ultimate tensile strength of the cable. The support also comprises a first ferrule disposed on the cable for bearing against a second layer. The first ferrule has a holding strength against the cable less than the ultimate tensile strength of the cable. There is also a second ferrule disposed on the cable having a holding strength against the cable which, when combined with the holding strength of the first ferrule, is at least as great as the ultimate tensile strength of the cable. The second ferrule is separated from the first ferrule by a space such that when the second layer bears against the first ferrule with a load greater than the holding strength of the first ferrule, the first ferrule is displaced on the cable towards the second ferrule until it bears against the second ferrule.

Applicant's invention is also a mining support for supporting rock within a mine which comprises a cable which is anchored in a bore hole within the rock. The bore hole contains an anchoring medium to anchor the cable. There is also a collar fixedly attached to one end of the cable for spinning the cable such that the anchoring medium is mixed by the cable within the bore hole and a bending restrictor disposed about the cable and attached to the collar for preventing a portion of the cable from bending as it is inserted into the bore hole.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
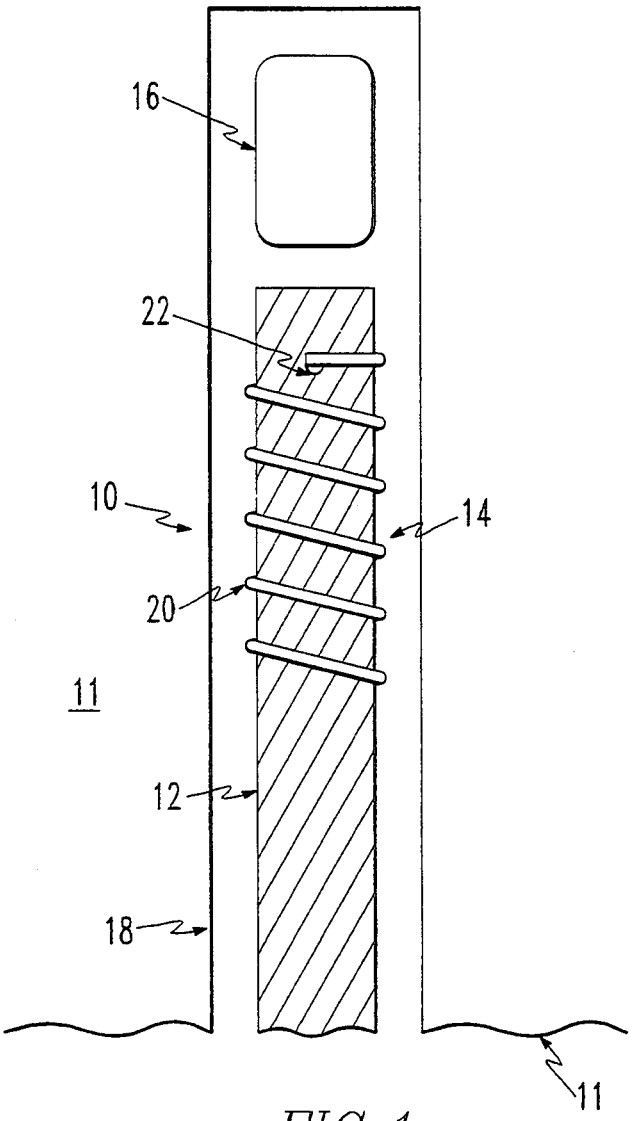
FIG. 1 is a schematic representation of the mining support.

Referring now to the drawings wherein like reference numerals refer to similar or identical parts throughout the several views, and more specifically to FIG. 1 thereof, there is shown a mine roof support 10 for supporting rock 11 within a mine. The mine roof support 10 is comprised of a cable 12 and means 14 for mixing resin in a resin cartridge 16 as the cable 12 is inserted into a bore hole 18 drilled in the rock in which the resin cartridge 16 is disposed. The mixing means 14 is positioned about the cable 12. Preferably, the mixing means 14 is fixedly secured to the cable 12. Preferably, the mixing means 14 includes a wire strand 20 wrapped around at least one end of the cable 12. A point weld 22 can be used to secure the strand 20 to the cable 12. The rock 11 encountered for anchorage can vary from soft shales to harder combinations of sandy shales to sandstone but is not limited thereto. The cable 12 is preferably a stranded metal cable having a diameter of ⅝", but ½" stranded cable can be used as well as other diameter stranded cable depending upon the application.

Figure 2:
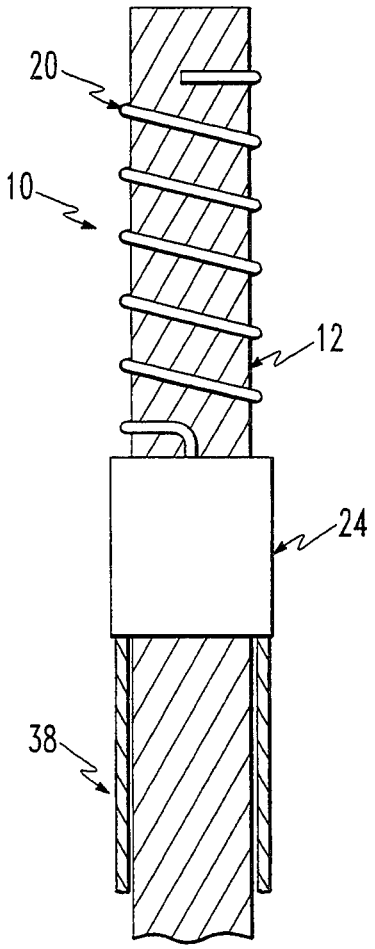
FIG. 2 is a schematic representation of the mining support with a drive ferrule disposed thereon.

In a preferred embodiment, and as shown in FIG. 2, there is a drive ferrule 24 fixedly attached to the cable for driving the end of the cable 12 into the bore hole 18. Preferably, the drive ferrule 24 is comprised of steel and is swaged to the cable 12. A 1" diameter drive ferrule 24 was found appropriate for a ⅝" cable 12. The strand 20 can be secured to the cable 12 by sandwiching one of its ends between the cable 12 and the drive ferrule 24 during swaging. Alternatively, the strand 20 can be secured by welding it to the drive ferrule 24. Preferably, a bending restrictor 38 is disposed on the drive ferrule 24 for preventing the cable from bending as it is inserted into the bore hole.

Figure 3:
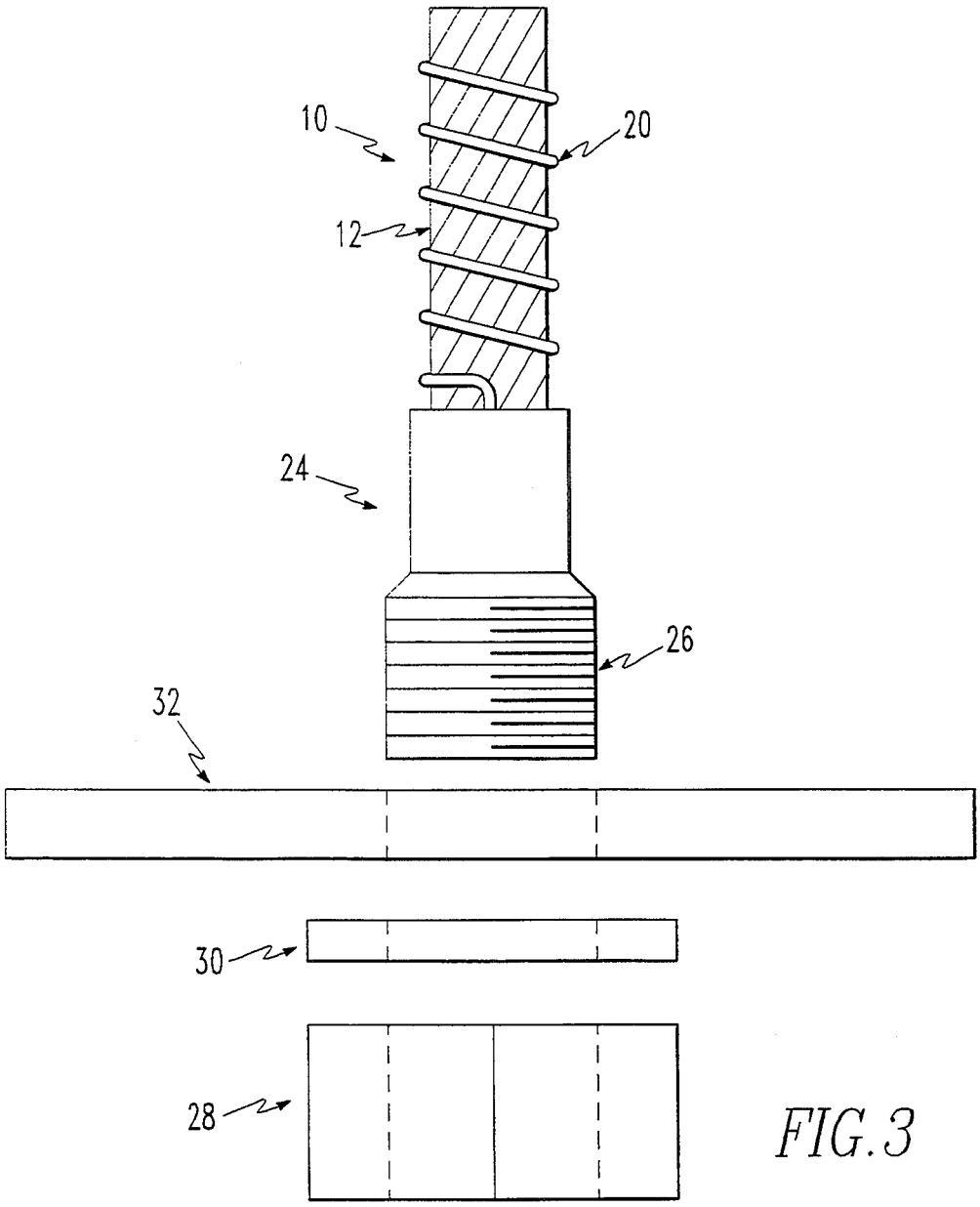
FIG. 3 is a schematic representation of the mining support with a threaded drive ferrule, hex nut, washer and contact plate.

Preferably, as shown in FIG. 3, the drive ferrule 24 comprises a threaded portion 26 and there is included a hex nut 28 and a washer 30 for tensioning the cable 12 after the resin has set. A contact plate 32, maintained in position by the hex nut 28, is used to bear against the rock 11.

Figure 4:
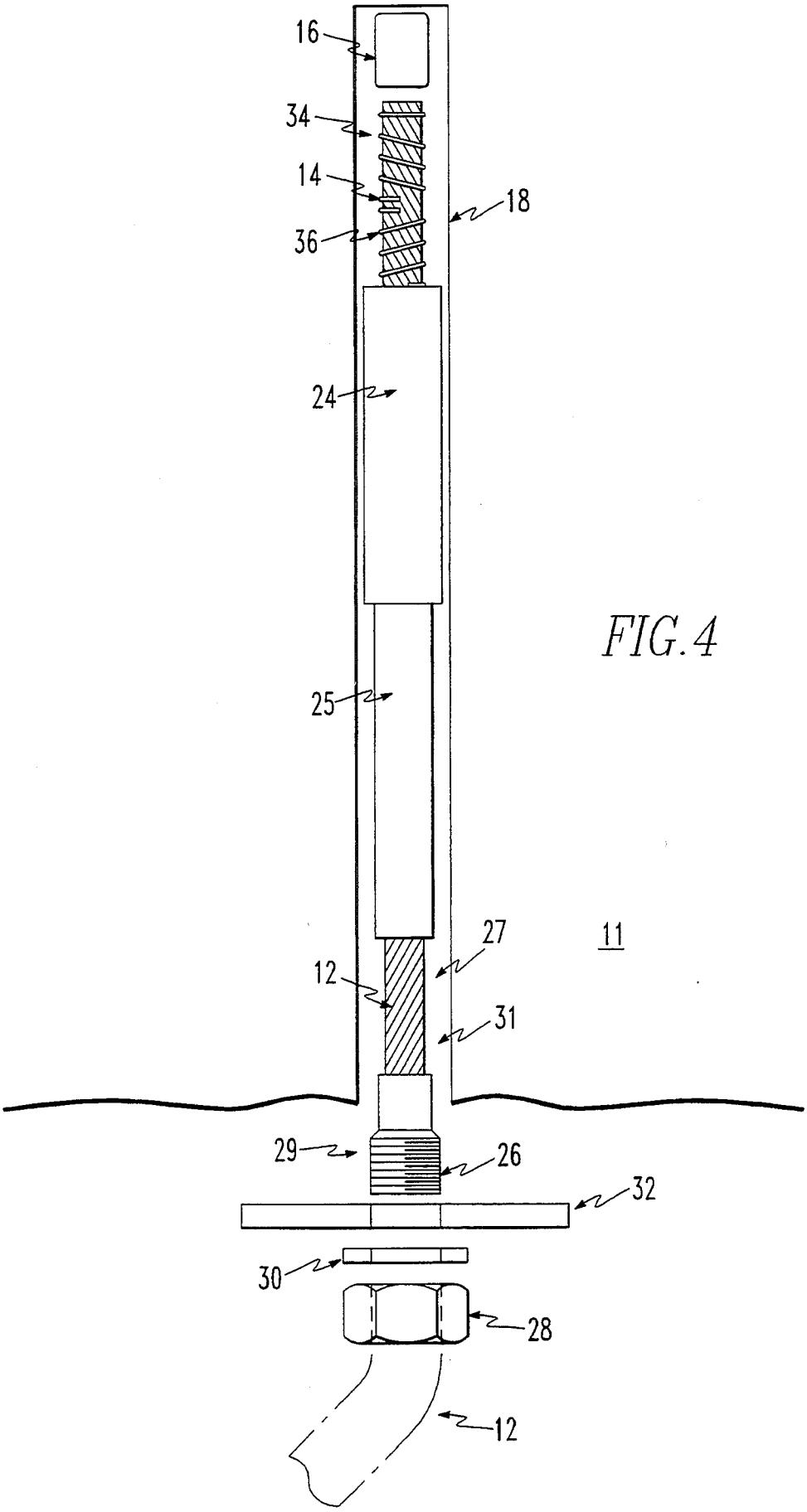
FIG. 4 is a schematic representation of the mining support with two opposing wire strands and a spacer.

Referring to FIG. 4, the mixing means 14 preferably comprises a first portion 34 which wraps about the cable 12 in a clockwise fashion and a second portion 36 which wraps around the cable 12 in a counterclockwise fashion such that the resin of the resin cartridge 16 is mixed in two different directions as the cable 12 is inserted into the bore hole 18.

Preferably, a spacer 25 is also provided. The spacer 25 butts up against the drive ferrule 24 and serves a first purpose of filling the space 27 between the cable 12 and the bore hole 18 such that an excessive amount of resin is not needed to fill the space 27. Spacer 25 also serves as an intermediate member which provides length between the drive ferrule 24 and a driving tool (not shown) so that the driving tool does not have to reach as deep within the bore hole 18. The spacer 25 is preferably comprised of a steel tube and is 9 inches long. The spacer 25 preferably has an outside diameter of ⅞ of an inch. The drive ferrule 24 preferably is 9 inches long and has an outside diameter of 1¼ of an inch and is swaged onto the cable 12.

Preferably, there is an end ferrule 29 which is attached to an end 31 of the cable 12. The end ferrule 29 preferably has a threaded portion 26 and there is included a hex nut 28 and a washer 30 for tensioning the cable 12 after the resin set. A contact plate 32, maintained in position by the hex nut 28 and washer 30, is used to bear against the rock 11.

It has been shown in tests that the length of the drive ferrule 24 is proportional to the pull strength of the mining support 10 (i.e. a mining support 10 with a longer drive ferrule 24 exhibits greater pull strength than one with a shorter drive ferrule 24). A mining support 10 having a 6¾ inch ferrule 24 was found to have a pull strength of 40,000 pounds.

The cable 12 is preferably a 1×7 stranded steel cable of 0.600 inch diameter having a minimum breaking strength of 58,600 pounds. The drive ferrule 24 is preferably attached 30"–36" from the end of the cable. The bending restrictor 38 is preferably comprised of aluminum tubing having an inside diameter slightly larger than the diameter of the cable 12 and having a length of 6"–12". Further, the bending restrictor 38 is preferably welded to the drive ferrule 24 to further prevent bending. The mixing strand 20 has an inside diameter which is slightly larger than that of the cable 12 and is preferably 24"–36" long.

Figure 5:
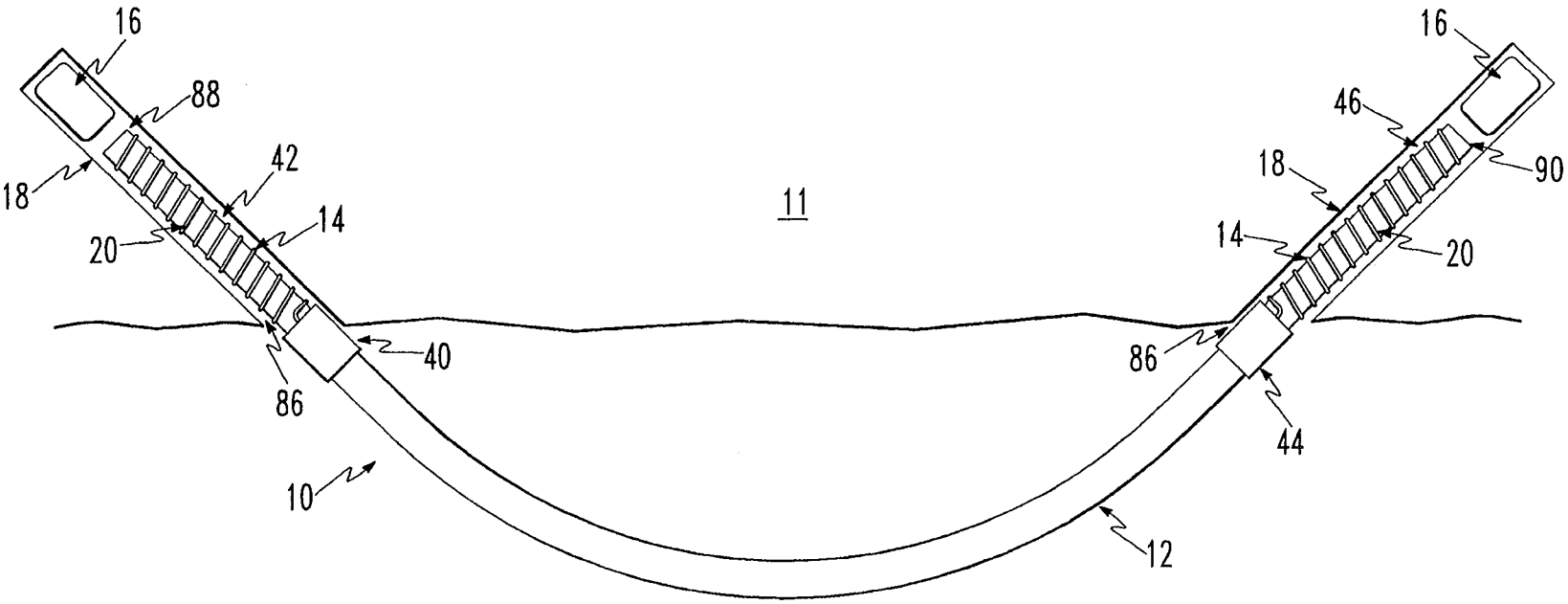
FIG. 5 is a schematic representation of an alternative embodiment of the mining support.

In an alternative embodiment, and as shown in FIG. 5, the mining support 10 is comprised of a cable 12 wherein each end of the cable 12 is adapted for insertion into a separate bore hole 18. The mining support 10 is comprised of a first drive ferrule 40 disposed in proximity to a first end 42 of the cable 12, and a second drive ferrule 44 disposed in proximity to a second end 46 of the cable 12. The drive ferrules 44, 46 are adapted for driving each end 42, 46 of the cable 12 into a separate bore hole 18 containing a resin cartridge 16 by a remote driving tool (not shown). Means for mixing 14 resin as disposed on each of the cable ends 42, 46. The mixing means 14 are adapted for mixing the resin as the cable ends 42, 46 are inserted into their respective bore hole 18 containing a resin cartridge 16. Preferably, the mixing means are helical wire strands 20 fixedly attached to the cable ends 42, 46. In a preferred construction, the wire strands are secured to the cable 12 by sandwiching a portion of their length between the cable 12 and respective drive ferrule 40, 44 during swaging. Preferably, each end 42, 46 of the cable 12 is similar in construction to the mining support 10 shown in FIG. 4. In this case, the portion of the cable 12 which extends past the threaded portion 26 is shown as a dotted line.

The present invention also pertains to a drive tool 48 for driving a rock support cable (not shown) having a drive ferrule secured thereon into a bore hole. The drive tool 48 comprises a cable portion 50 having a u-shaped cross section such that the drive tool 48 can bear against the drive ferrule yet is removable therefrom after the cable has been properly positioned with the bore hole. The drive tool 48 also includes a drive portion 52 having a closed cross section of or accepting an impact force.

The novelty of driving tool 48 is that it can be removed from the cable after the cable has been positioned in the bore hole. All previously known forms of cable/ferrule driving tools are fixedly attached to the cable and hang below the inserted cable, thereby creating an obtrusive obstacle and an unnecessary hazard which could lead to a cave-in.

Figure 6:
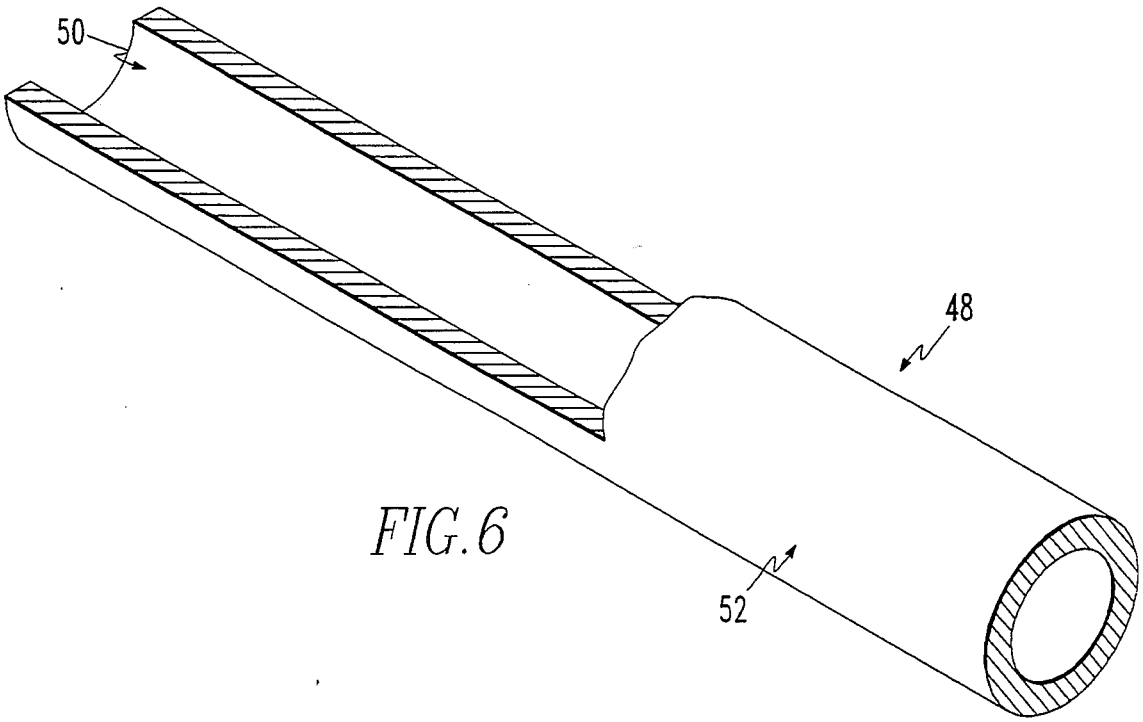
FIG. 6 is a schematic representation showing the driving tool.
Figure 7A:
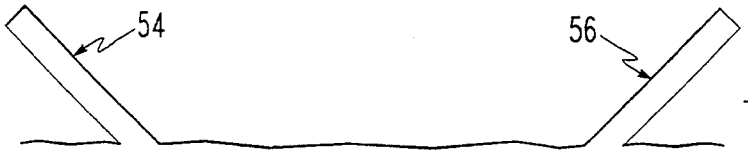
FIGS. 7A–7F are schematic representations showing a first method of supporting rock in a mine.
Figure 7B:
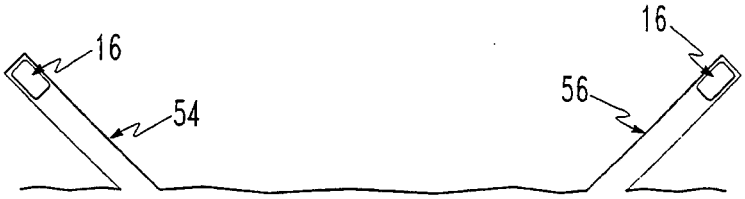
Figure 7C:
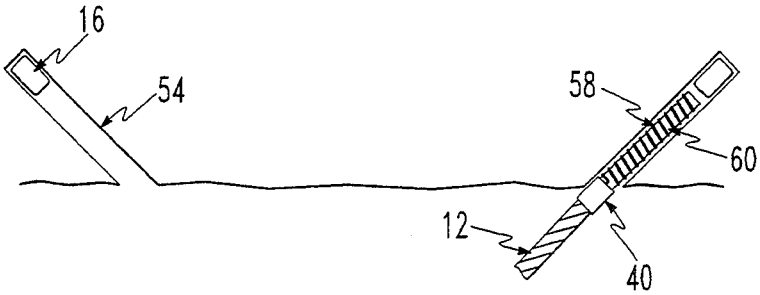
Figure 7D:
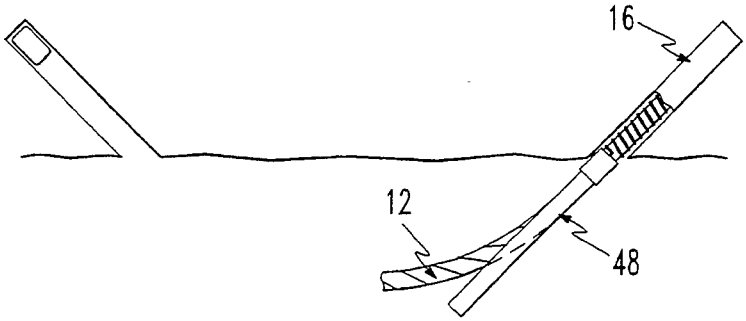
Figure 7E:
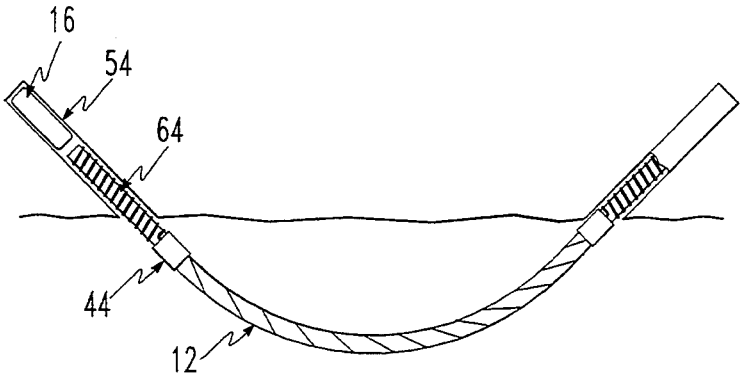
Figure 7F:
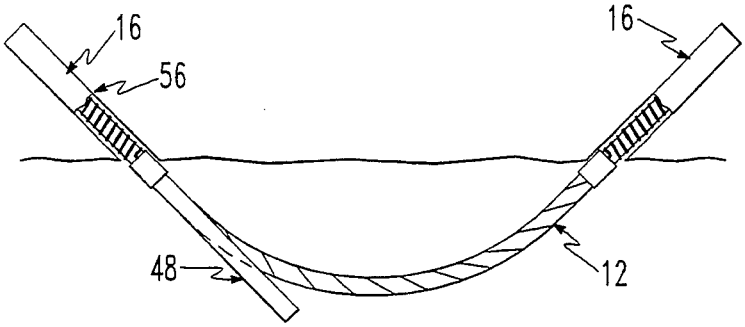
Figure 8A:
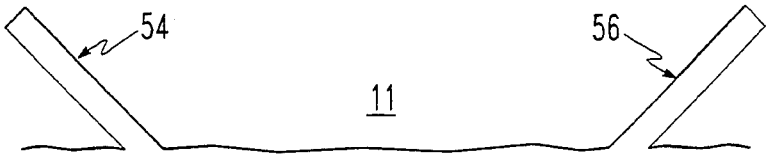
FIGS. 8A–8D are schematic representations showing a second method of supporting rock in a mine.
Figure 8B:
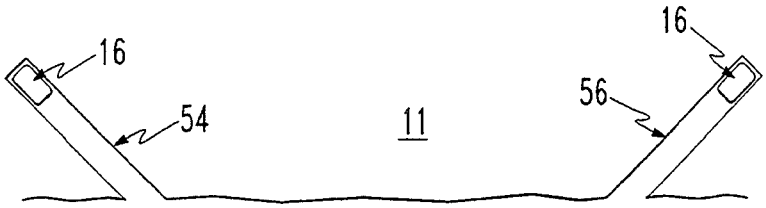
Figure 8C:
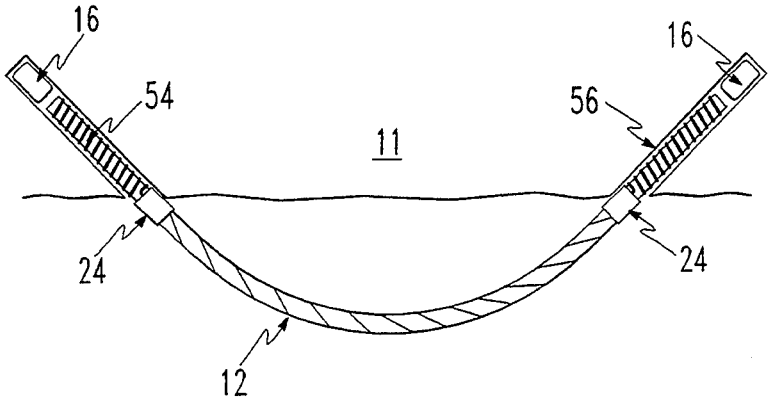
Figure 8D:
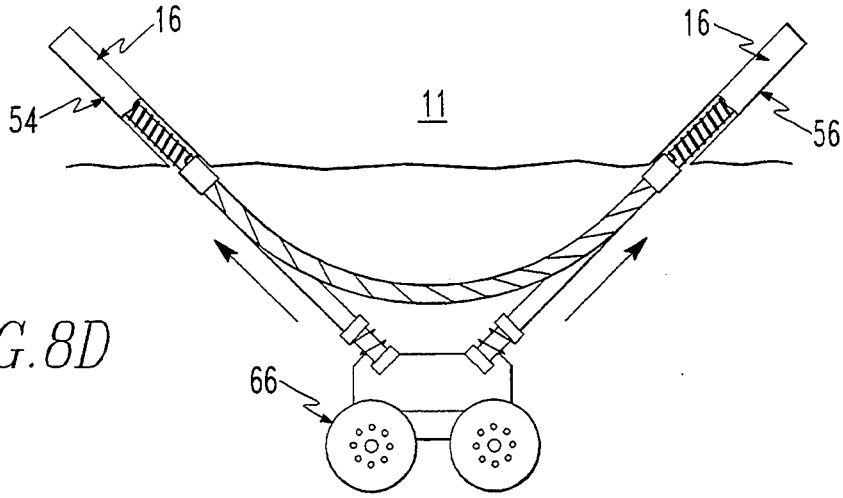

The present invention also pertains to a system for supporting a rock within a mine. The system is comprised of the cable 12 as described in FIG. 5 and the driving tool 48 as shown in FIG. 6.

The present invention also pertains to a method of supporting rock within a mine using the mining support 10. As shown in FIG. 7, the method comprises the steps of drilling a first bore hole 54 and a second bore hole 56 into the rock 11. Then, there is the step of inserting a resin cartridge 16 into each bore hole 54, 56. Then, there is the step of orienting a first end 58 of the cable 12 having a first wire strand 60 within the first bore hole 54. A first drive ferrule 40 is disposed in proximity to the first end 58. Next, there is the step of forcing the first drive ferrule 40 towards the first bore hole 54 with a removable drive tool 48 to puncture and mix the resin cartridge 16 and to position the first end 58 of the cable 12 within the first bore hole 54. Then, there is the step of orienting the second end 64 of the cable 12 having a second drive ferrule 44 within the second bore hole 56. The second drive ferrule 44 is disposed in proximity to the second end 64 of the cable 12. Finally, there is the step of forcing the second drive ferrule 44 towards the second bore hole 56 with the removable drive tool 48 to puncture and mix the resin cartridge 16 and to position the second end 64 of the cable 12 within the second bore hole 56 such that the cable 12 is pulled tight between the bore holes 54, 56.

As shown in FIG. 8, the present invention also pertains to a second method of supporting rock in a mine. The method comprises the steps of first drilling a first bore hole 54 and a second bore hole 56 into the rock 11. Then, there is the step of inserting a resin cartridge 16 into each bore hole 54, 56. Next, there is the step of orienting each end of a cable within a separate bore hole wherein each end has a wire strand 20 positioned about it for mixing the resin cartridge 16 and a drive ferrule 24 for driving each end of the cable 12 into its respective bore hole 54, 56. Finally, there is the step of simultaneously forcing each end of the cable 12 within its respective bore hole 54, 56 by forcing the drive ferrules with a remote roof bolting machine 66 such that the resin cartridge 16 is punctured and mixed and the cable 12 is pulled tight between the bore holes 54, 56.

Figure 9:
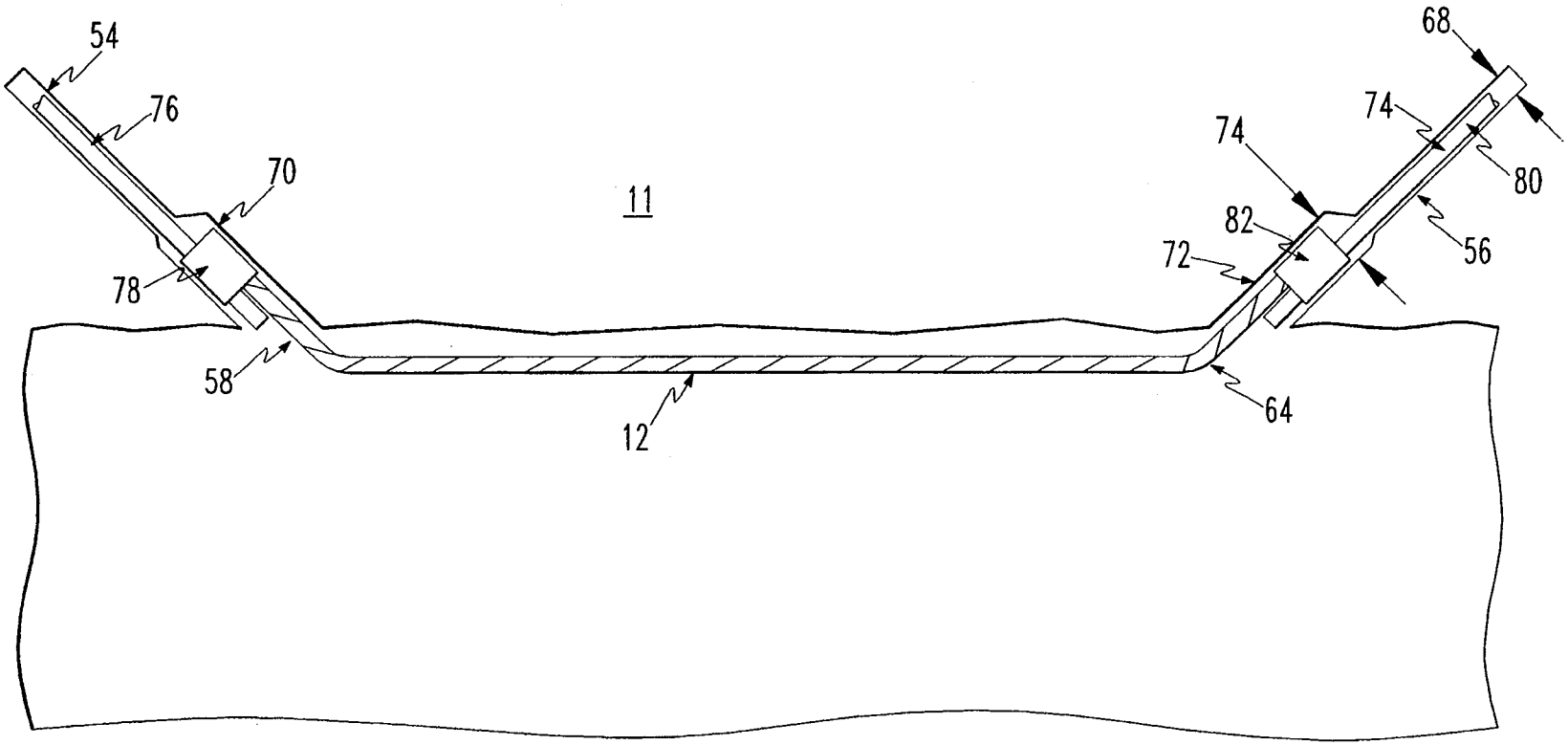
FIG. 9 is a schematic representation showing a third method of supporting rock in a mine.

The invention also pertains to a third method of supporting rock in the roof of a mine, as shown in FIG. 9. The method comprises the steps of drilling a first bore hole 54 and a second bore hole 56 into the rock 11. The bore holes 54, 56 have a first diameter 68 and a first length. Then, there is the step of drilling a first countersink hole 70 and a second countersink hole 72, concentric with the first and second bore holes 54, 56, respectively. The countersink holes 70, 72 have a second diameter 74 larger than the first diameter 68 and a second length smaller than the first length.

Then, there is the step of anchoring a first rock bolt 76 within the first bore hole 54. The first rock bolt 76 is attached to a first end 58 of a cable 12 with a first connector element 78. The first connector element 78 is disposed within the first countersink hole 70 after the first rock bolt 76 is anchored. Finally, there is step of anchoring a second rock bolt 80 within the second bore hole 56. The second rock bolt 80 is attached to the second end 64 of the cable 12 with a second connector element 82. The second connector element 82 is disposed within the second countersink hole 72 and the cable 12 is taught after the second rock bolt 80 is anchored.

In the operation of the preferred embodiment and as shown in FIG. 5, a bore hole 18 is first drilled into the rock 11. The rock 11 can comprise the roof of a mine, or the rock can be a coal rib on the side of a mine, to mention but a few examples of where the mining support 10 can be installed. Then, another bore hole 18 is drilled into the rock. The bore holes have a diameter of $1\frac{3}{8}''$ and a length of $5\frac{1}{2}'$. The bore holes are drilled at an angle of 45° to the roof of the mine. The openings 86 of the bore holes are 17′ apart. Resin cartridges 16 are inserted into the bore holes.

The cable 12 has a length of 28′ and is comprised of $1\times7$ strand steel cable having a minimum breaking strength of 58,600 pounds. Steel drive ferrules 40, 44 are swaged to the cable 12 30″ from their respective terminal ends 88, 90 of the cable 12. The drive ferrules 40, 44 have a diameter of $1\frac{1}{4}''$ and are 2″ long. Steel helical wire strands 20 are welded onto the ferrules 40, 44. The strands 20 are 28″ long. The ends of the cable 12 are inserted into a separate bore hole until resistance is felt. Then, the drive ferrules 40, 44 are forced towards their bore holes to puncture the resin cartridges 16 and to orient the ends of the cable 12 within their respective bore hole. The drive ferrules are then simultaneously forced into the bore holes using a drive tool. As the ends of the cable 12 are forced into the bore holes, the resin cartridges 16 rupture. Further pushing causes the ends of the cable 12 to move deeper into the bore holes and through the ruptured resin cartridges 16. The resin cartridges 16 flow past the helical strands 20 and are caused to mix in a spiral motion around the cable 12 even though the cable is not turning. The cable 12 is pulled tight and the mixed resin cartridge 16 then is allowed to harden to anchor the ends of the cable 12 within the bore holes.

Figure 10:
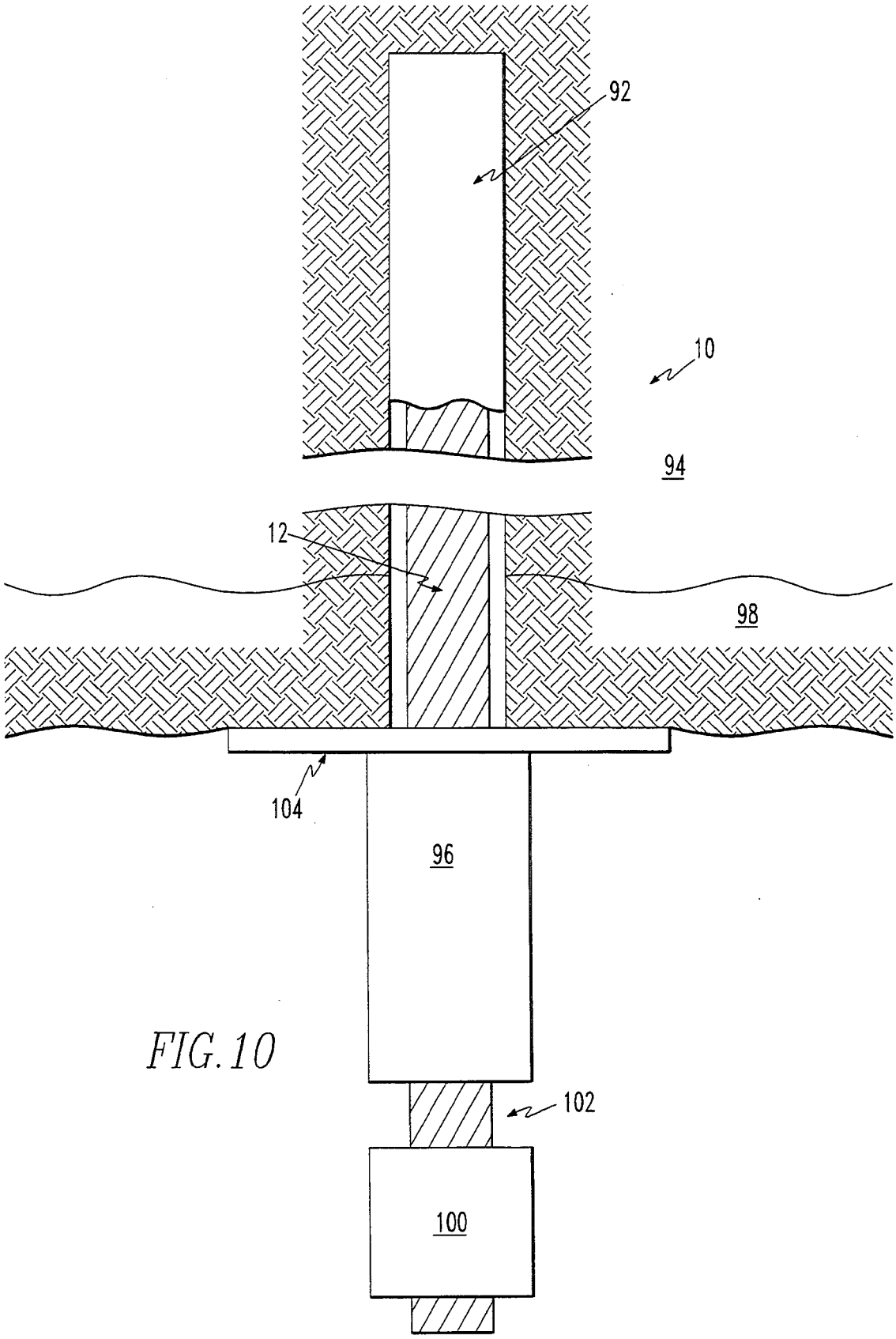
FIG. 10 is a schematic representation showing an alternative embodiment of the support.

In a preferred embodiment and as shown in FIG. 10, the support 10 is comprised of a cable 12 and means 92 for anchoring the cable 12 to a first layer 94. The anchoring means 92 has a holding strength against the cable which is greater than the ultimate tensile strength of the cable 12. The ultimate tensile strength of a $\frac{5}{8}$ inch stranded steel cable 12 is about 60,000 pounds.

A first ferrule 96 is disposed and preferably swaged onto the cable 12 for bearing against a second layer 98. The first ferrule 96 has a holding strength against the cable 12 less than the ultimate tensile strength of the cable. For instance, if the ultimate strength of the steel cable is 30,000 pounds, then the first ferrule 96 could have, for instance, a holding strength against the cable 12 of 20,000 pounds.

The support 10 also has a second ferrule 100 swaged onto the cable 12 that has a holding strength against the cable 12, which, when combined with the holding strength of the first ferrule 96, is at least as great as the ultimate tensile strength of the cable 12. (Following the example, the second drive ferrule 100 would have a holding strength against the cable 12 of at least 10,000 pounds.) The second ferrule 100 is separated from the first ferrule 96 by a space 102 such that when the second layer 98 bears against the first ferrule 96 with a load greater than the holding strength of the first ferrule 96, the first ferrule 96 is displaced on the cable 12 towards the second ferrule 100 until it bears against the first ferrule 96. In this manner, the support 10 will have a built-in mechanism indicating imminent collapse of the second layer 98.

Preferably, the support 10 includes a contact plate 104 which is disposed about the cable 12 between the first ferrule 96 and the second layer 98.

The support 10 could be used for supporting rock in a mine, for instance. In this case, the first and second layers 94 and 98 would be earth strata and the anchoring means 92 would be resin or grout. Alternatively, the support 10 could be used for any supporting cable as in a bridge. In its broadest sense, the support 10 provides a fixed element (ferrule) on a cable which is purposely designed to slide before collapse of the cable, thereby serving as an indicator of the load being supported.

Figure 11:
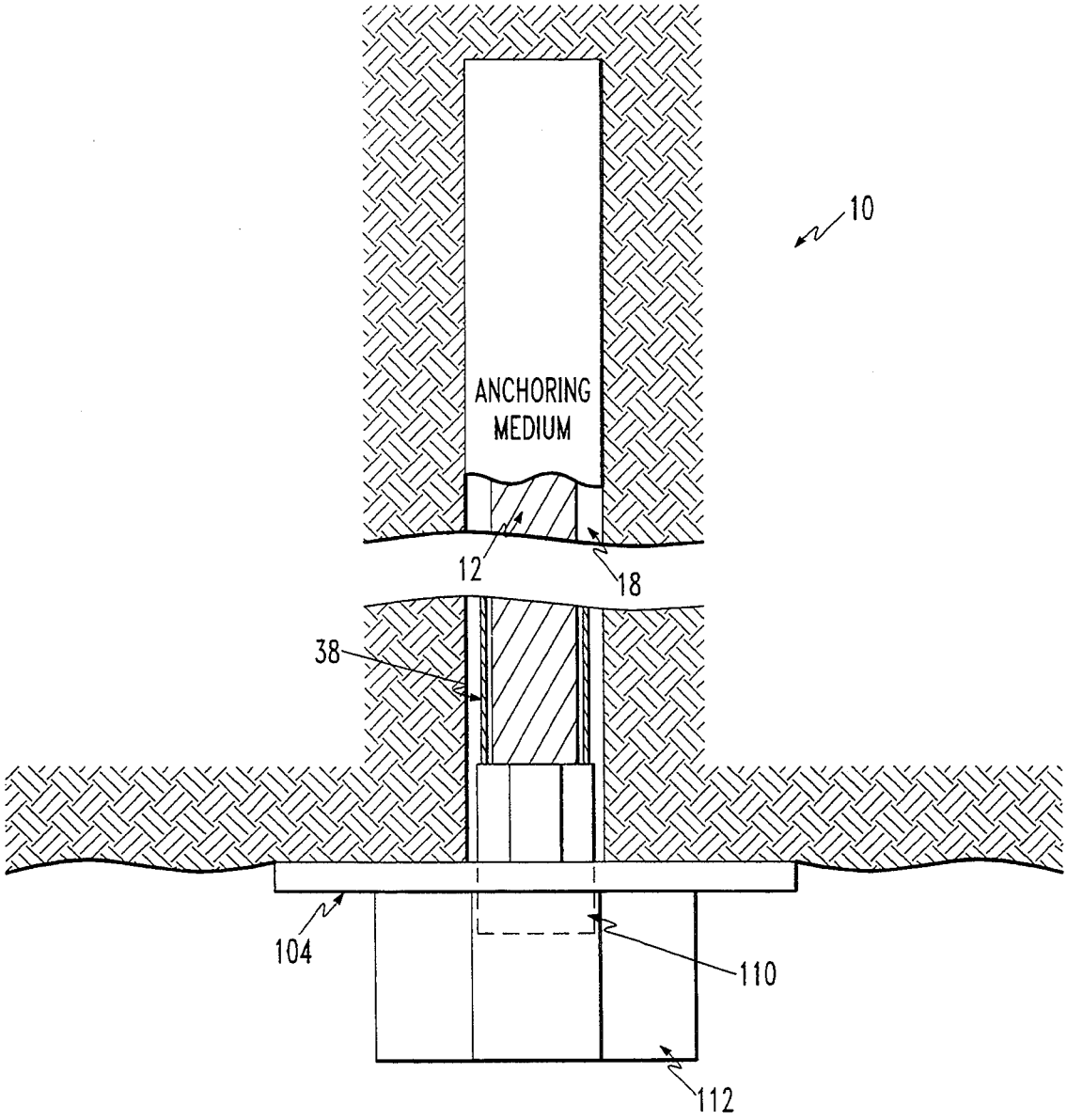
FIG. 11 is a schematic representation showing an alternative embodiment of the support.

In an alternative embodiment and as shown in FIG. 11, the support 10 is comprised of a cable 12 which is supported in a bore hole 18 within the rock. The bore hole 18 contains an anchoring medium, such as resin. There is a collar 108 disposed on one end of the cable 12 for spinning the cable such that the anchoring medium is mixed by the cable 12 in the bore hole 18. There is also a bending restrictor 38 disposed about the cable 12 which is fixedly attached to the collar 108 for preventing a portion of the cable 12 from bending as it is inserted into the bore hole 18. In this embodiment, the cable 12 is purposely adapted for spinning as opposed to the earlier embodiments wherein the cable was inserted into the bore hole 18 and the mixing means mixed the resin. In this embodiment, the cable 12 serves as the mixing means. Preferably, the collar 108 defines a threaded portion 110 and there is a hex nut 112 for tensioning the cable after the resin has set and a contact plate 104 for bearing against the rock face. Preferably, the anchoring medium is resin.

In the operation of the embodiment as shown in FIG. 11, the cable 12 is inserted into the bore hole 18 within the rock. A bending restrictor 38 disposed about the cable 12 prevents the cable 12 from bending while it is being inserted into the bore hole 18 and impacts the resin capsule. A resin capsule already present within the bore hole 18 is punctured by the cable 12 as it moves into and fills the bore hole 18. Once the resin capsule is punctured, the cable 12 is disposed in the bore hole 18 with the contact plate 104 bearing against the rock face. A wrench (not shown) is engaged with the hex nut 112 to spin the cable 12 and thus mix the resin in the bore hole 18. The hex nut 112 is engaged to the collar 108 that is disposed on the cable 12 through threaded portion 110. When the hex nut 112 is rotated, the cable 12 is also caused to rotate. Once desired rotation has been applied to the cable 12, the cable is held in place until the resin sets.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method of supporting rock in the roof of a mine comprising the steps of:

drilling a first bore hole and a second bore hole each having a first diameter and a first length into the rock;

drilling a first countersink hole and a second countersink hole, concentric with the first and second bore holes, respectively, each having a second diameter larger than the first diameter and a second length smaller than the first length;

anchoring a first rock bolt within the first bore hole, said first rock bolt is attached to the first end of a cable with a first connector element, said first connector element disposed within the first countersink hole after the first rock bolt is anchored; and anchoring a second rock bolt within the second bore hole, said second rock bolt is attached to the second end of a metal cable with a second connector element, said second connector element disposed within the second countersink hole and the cable is taut after the second rock bolt is anchored.

2. A support comprising:

a cable;

means for anchoring the cable to a first layer, said anchoring means having a holding strength against the cable greater than the ultimate tensile strength of the cable;

a first ferrule disposed on said cable for bearing against a second layer, said first ferrule having a holding strength against the cable less than the ultimate tensile strength of the cable;

a second ferrule disposed on said cable having a holding strength against the cable which, when combined with the holding strength of the first ferrule, is at least as great as the ultimate tensile strength of the cable, said second ferrule separated from the first ferrule by a space such that when the second layer bears against the first ferrule with a load greater than the holding strength of the first ferrule, the first ferrule is displaced on the cable towards the second ferrule until it bears against the second ferrule.

3. A support as described in claim 2 wherein a contact plate is disposed about the cable between the first ferrule and the second layer.

4. A support as described in claim 3 wherein the first layer is comprised of earth strata.

5. A support as described in claim 4 wherein the second layer is comprised of earth strata.

6. A support as described in claim 5 wherein the anchoring means comprises resin or grouted cement or gypsum.

7. A support as described in claim 6 wherein the drive ferrules are swaged onto the cable.

8. A mining support for supporting rock within a mine comprising:

a cable;

means for mixing resin in a resin cartridge as the cable is inserted without turning into a bore hole drilled in the rock in which said resin cartridge is disposed, said mixing means including a helical wire strand which wraps at least one time around the cable, said helical wire strand structurally interconnected with said cable;

a drive ferrule having a threaded portion is fixedly attached to the cable for driving a first end of the cable in the bore hole;

a hex nut and washer for tensioning the cable after the resin has set; and a contact plate for bearing against the rock which is maintained in position by the hex nut, said hex nut screwed onto the threaded portion to maintain the washer and contact plate in a desired position.

9. A mining support as described in claim 8 wherein a bending restrictor is fixedly attached to the drive ferrule such that at least a portion of the cable is prevented from bending as it is inserted into the bore hole.

10. A mining support as described in claim 9 wherein the helical strand comprises a first portion which wraps about the cable in a clockwise fashion and a second portion which wraps about the cable in a counterclockwise fashion such that the resin is mixed in two different directions as the cable is inserted into the bore hole.

* * * * *